US006439932B1

(12) United States Patent
Ripolone

(10) Patent No.: US 6,439,932 B1
(45) Date of Patent: Aug. 27, 2002

(54) MULTIPLE PROTECTED LIVE CIRCUIT WET CONNECT SYSTEM

(75) Inventor: James G. Ripolone, Tomball, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/880,603

(22) Filed: Jun. 13, 2001

(51) Int. Cl.[7] ..... H01R 17/18
(52) U.S. Cl. ..... 439/668; 439/924.1
(58) Field of Search ..... 439/668, 266, 439/267, 669, 67, 77, 843, 924.1

(56) References Cited

U.S. PATENT DOCUMENTS

| | | | | |
|---|---|---|---|---|
| 3,829,814 A | * | 8/1974 | Straus | 439/14 R |
| 4,039,237 A | | 8/1977 | Cullen et al. | 339/91 R |
| 4,695,116 A | | 9/1987 | Bailey et al. | 439/188 |
| 4,705,485 A | | 11/1987 | Hansen | 439/669 |
| 5,022,872 A | | 6/1991 | Shichida | 439/668 |
| 5,058,683 A | | 10/1991 | Godfrey et al. | 166/381 |
| 5,376,206 A | * | 12/1994 | Maurer et al. | 156/242 |
| 5,409,403 A | | 4/1995 | Falossi et al. | 439/668 |
| 5,522,738 A | | 6/1996 | Lace | 439/669 |
| 5,820,416 A | | 10/1998 | Carmichael | 439/668 |

* cited by examiner

*Primary Examiner*—Tho D. Ta
*Assistant Examiner*—Phoung Nguyen
(74) *Attorney, Agent, or Firm*—Madan, Mossman & Sriram, P.C.

(57) ABSTRACT

A multiple contact connector which can be used to protect live circuits including power and signal line, during connection and disconnection in wet environments, includes a male probe adapted to removably seat in a female receptacle. The male probe and the female receptacle are constructed to attach to equipment which includes downhole tools. The probe includes at least three uniquely spaced contacts on an outer surface. The receptacle has at least three contacts on an inner surface spaced so as to mate with the probe contacts when the probe is seated in the receptacle. The contacts are spaced such that no more than one of the at least three probe contacts may be aligned with and contacting any of the at least three receptacle contacts, unless said probe is seated within said receptacle. This prevents cross coupling of the live power and signal lines thereby preventing damage to the associated circuits.

12 Claims, 2 Drawing Sheets

MULTIPLE PROTECTED LIVE CIRCUIT WET CONNECT SYSTEM

BACKGROUND OF THE INVENTION

1. Field of the Invention

This invention relates to an electrical connector. More specifically, it is directed to a releasable electrical connector having multiple individual live contacts during engagement and disengagement in a wet environment.

2. Description of the Related Art

A number of electrical tools are used within wet environments. Examples of such tools in the downhole environment are logging systems, measurement while drilling, and logging while drilling devices. These wet environment tools require electrical connection between each other and sometimes to surface equipment in order to transmit and receive signals and power. Wet environment connections are also required for subsea applications, including communications cables. U.S. Pat. No. 5,358,418 and U.S. Pat. No. 4,588,243 discuss examples of such applications in the downhole environment.

From time to time it is desirable or necessary to connect, disconnect, or reconnect the wet environment instruments and equipment. For example, to replace or add electrical equipment, the instruments must be disconnected. Therefore, a releasable connector is desirable to complete these tasks without having to remove the equipment and instruments from the wet environment.

Many wet environment instruments contain a multitude of individual instruments. Each of these instruments must individually communicate with the surface equipment or other downhole equipment. Accordingly, each of the instruments preferably utilizes its own communication wire that, in turn, requires a separate connector. In addition, power connections must also be made. In many instances, connectors must be connected or disconnected with live, powered circuits. Heretofore, releasable downhole multi-contact connectors have used equally spaced contacts in a probe/receptacle style configuration, for example, see U.S. Pat. No. 5,820,416. In making or breaking such a connector, live signal, communication, and power lines are allowed to come in contact with each other causing possible cross coupling or damage to the associated circuits.

Thus there is a demonstrated need for a wet connect system which provides for making or breaking multiple signal, communication, and power lines while preventing cross coupling of those multiple lines.

SUMMARY OF THE INVENTION

The methods and apparatus of the present invention overcome the foregoing disadvantages of the prior art by providing a connector with contact spacing selected to prevent cross coupling of multiple lines during engagement and disengagement of the connector.

According to one preferred embodiment, a male probe has at least three electrical contacts located on its outer surface. The contacts are uniquely spaced axially along the probe. A female receptacle has an opening at one end to receive the probe. The receptacle has at least three electrical contacts located on an inner surface and axially spaced to be in juxtaposition with the probe contacts when the probe is seated in the receptacle, creating at least three pairs of contacts, each pair acting cooperatively to conduct electricity. The contacts on the probe and the contacts on the receptacle are uniquely spaced in the axial direction such that no more than one of the probe contacts may be aligned with and contacting any of the at least three receptacle contacts, unless said probe is seated within said receptacle.

In another preferred embodiment, a cylindrical male probe has at least three electrical contacts located on its outer surface. The contacts are uniquely spaced axially along the probe. A cylindrical female receptacle has an opening at one end to receive the probe. The receptacle has at least three electrical contacts located on an inner surface and axially spaced to be in juxtaposition with the probe contacts when the probe is seated in the receptacle, creating at least three pairs of contacts, each pair acting cooperatively to conduct electricity. The contacts on the probe and the contacts on the receptacle are uniquely spaced in the axial direction such that no more than one of the probe contacts may be aligned with and contacting any of the at least three receptacle contacts, unless said probe is seated within said receptacle.

Examples of the more important features of the invention thus have been summarized rather broadly in order that the detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals, wherein.

DESCRIPTION OF PREFERRED EMBODIMENTS

It is a feature of many downhole tools to have signal, communication, and power line connections made in a common coaxially engageable connector. These lines may be at different voltage potentials such that cross-coupling of the lines during the making and breaking of a common connector may cause damage to the associated circuits of the cross-coupled lines.

Figure 1:
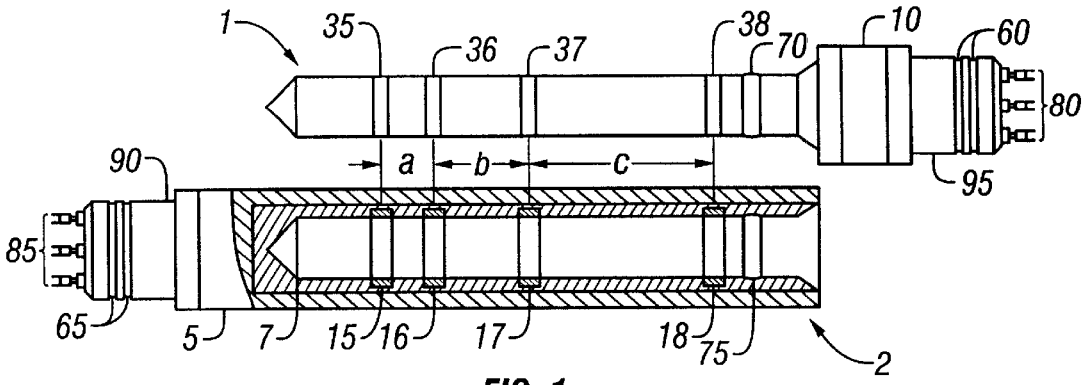
FIG. 1 is schematic representation of a connector according to one embodiment of the present invention.

FIG. 1 shows a pictorial representation of a preferred embodiment of a connector according to the present invention. The connector of the present invention may have a plurality of electrical contacts. For example purposes, a four conductor connector is described. A female receptacle 2 and a male probe 1 are adapted to be releasably engageable in order to make electrical connections. Female receptacle 2 is illustrated as a sectional view having a receptacle housing 5. Housing 5 is a hollow member with an opening at one end and having a cylindrical insulator insert 7 coaxially disposed within. Receptacle conductor rings 15–18, also called contact rings, are embedded in the inner surface of insulator 7 at predetermined unique axial spacings a, b, and c as shown in FIG. 1. Electrical wires (not shown) are routed from each of the four contacts 15–18, within housing 5, to a corresponding receptacle terminal 85 at bulkhead 90 of receptacle housing 5. While only three such terminals 85 are illustrated in FIG. 1, each contact 15–18 is wired to a separate terminal 85. Elastomer seals 65 seal out environmental contaminants when bulkhead 90 is installed in a suitable bore in a downhole tool (not shown). Seal groove 75 is located proximate the open end of insulator 7.

In the preferred embodiment, housing 5 is a metallic material suitable for downhole use, which may include but is not limited to stainless steel, beryllium copper, or titanium. Insulating insert 7 may be a molded elastomer with embedded contact rings. Alternatively, insert 7 may consist of an insulating sleeve of a plastic material adhesively bonded into housing 5. In yet another alternative embodiment, multiple interlocking parts (not shown) with alternating insulator parts and contact rings are captured or bonded in housing 5. Such construction techniques are known in the art and are not described further.

Male probe 1 is a cylindrical member adapted to be inserted into receptacle 2. Probe 1 is illustrated in FIG. 1 having probe contact rings 35–38 embedded within its outer surface. Probe contact rings 35–38 are correspondingly axially spaced such that upon complete insertion of probe 1 in receptacle 2, probe contact rings 35–38 will be in juxtaposition with receptacle contact rings 15–18 respectively, thereby completing an electrical circuit at each pair of juxtaposed contacts. Wires (not shown) connect each probe contact ring 35–38 to a separate probe terminal 80 at bulkhead end 95. Elastomer seals 60 seal out environmental contaminants when bulkhead 90 is installed in a suitable bore in a downhole tool (not shown).

Probe 1 may be constructed as a molded elastomer over a metallic core (not shown) with contact rings embedded in the elastomer. Alternatively, probe 1 may be constructed of interlocking insulator and contact rings as is known in the art. For wet connect applications, elastomeric seal 70 is molded into probe 1 near shoulder 10. Seal groove 75 is located in receptacle 2 proximate the open end of receptacle 2. Seal 70 and seal groove 75 are adapted to provide a compression type seal to prevent environmental fluids from entering the seal cavity after engagement.

It is a major feature of this invention that during engagement (insertion) or disengagement (extraction) of probe 1 with receptacle 2, the predetermined unique axial spacings a, b, and c of the juxtaposed contacts are such that no more than one probe contact ring may be in contact with any of the receptacle contact rings at any time during insertion or extraction, unless probe 1 is fully seated in receptacle 2. This feature prevents cross coupling of live signal and power lines in the downhole tools, thereby preventing damage to the associated circuitry. Multiple contact spacing patterns are possible. An example of such a pattern for a four contact connector, referring to FIG. 1, uses spacing a as a base dimension, then spacing b=2a and spacing c=4a. Other contact spacing patterns may be determined without undue experimentation.

Figure 2:
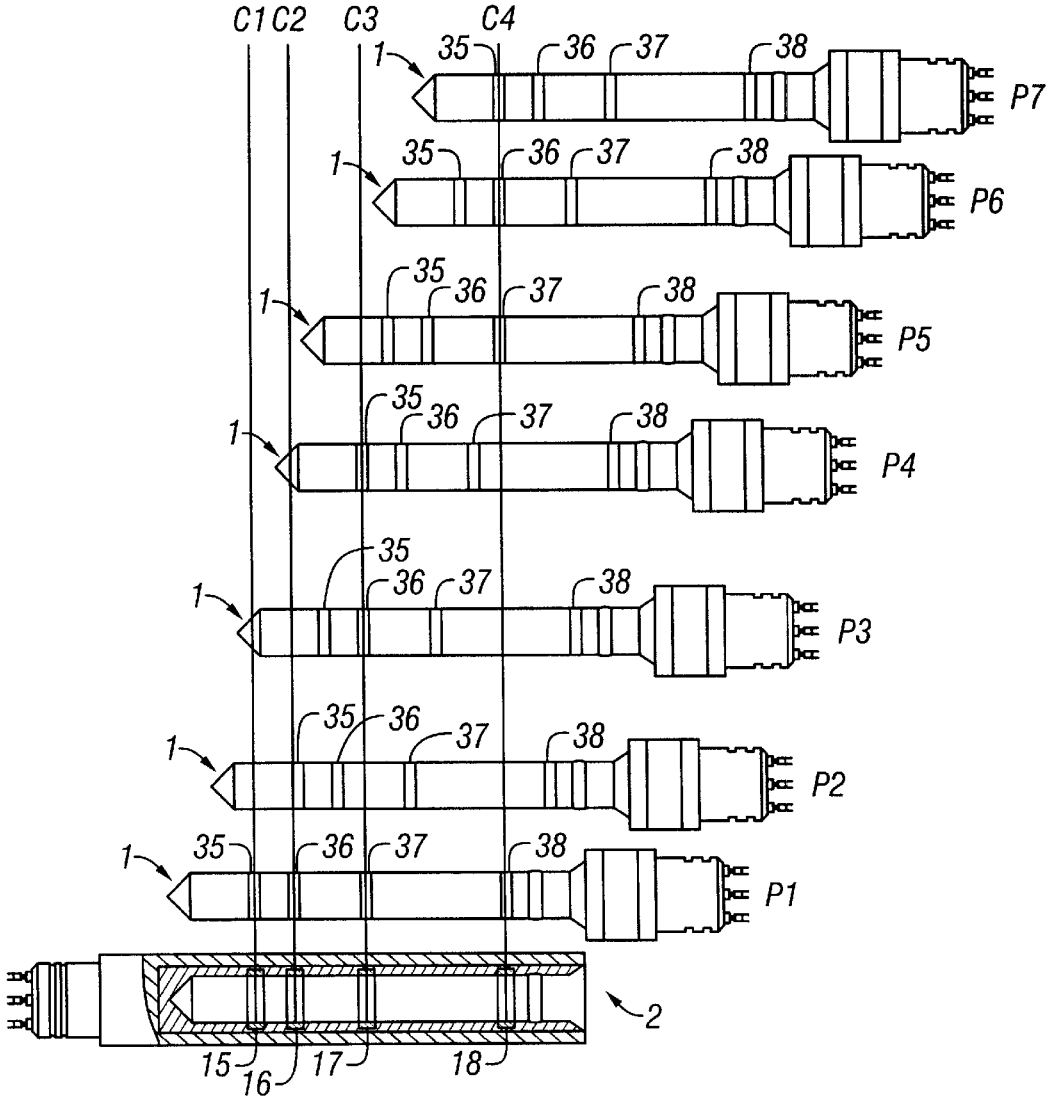
FIG. 2 is a schematic showing the relative contact positions during disengagement of a connector according to one embodiment of the present invention; and, FIG. 3 is a schematic representation of a connector according to one embodiment of the present invention.

FIG. 2 shows a sequence of positions P1–P7 of probe 1 relative to receptacle 2 during engagement or disengagement of probe 1 with receptacle 2. Position P1 illustrates the alignment of receptacle contacts 15–18 with probe contacts 35–38 respectively when probe 1 is fully inserted in receptacle 2. As probe 1 is extracted from receptacle 2, as seen at positions P2–P7, probe contacts 35–38 become misaligned with receptacle contacts 15–18. Lines C1–C4 illustrate when a probe contact will be in alignment with a receptacle contact. For, example, in FIG. 2, as probe 1 is moved to position P2, probe contact 35 is aligned with receptacle contact 16 with no other contacts in alignment. As probe 1 is further extracted, it can be clearly seen in FIG. 2 that no more than one probe contact rings is ever aligned with any of the receptacle contact rings at any position during the probe extraction, thereby preventing cross-coupling of the multiple live circuits. It will be appreciated that other numbers of contacts may be incorporated in such a connector as long as the spacings between contacts is selected to prevent multiple circuits from being engaged during engagement and disengagement of the probe 1 and receptacle 2.

Figure 3:
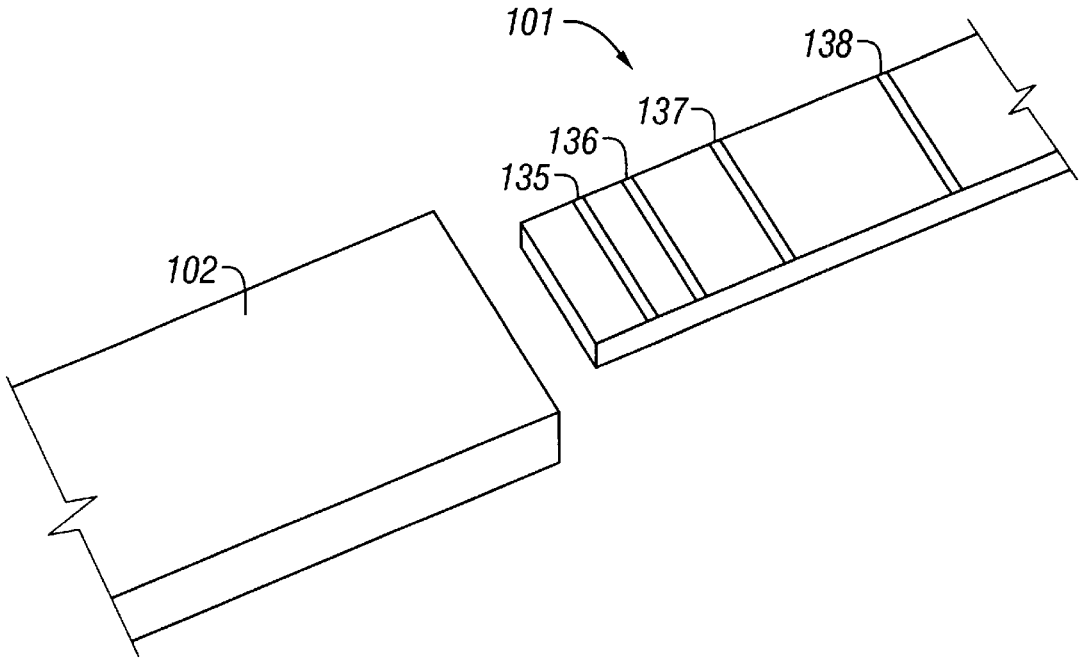

While the forgoing description describes a cylindrically shaped connector, other embodiments may be non cylindrical such as the flat connector shown in FIG. 3. Probe 101 is depicted as a thin rectangular plate with contacts 135–138 embedded in an outer surface. Receptacle 102 is adapted to receive probe 101 and has internal contacts (not shown) positioned so as to mate with contacts 135–138 when probe 101 is seated in receptacle 102. Other polyhedral shapes are also contemplated by this invention.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention. It is intended that the following claims be interpreted to embrace all such modifications and changes.

What is claimed is:

1. A multiple contact wet connector system for preventing cross-coupling during connection and disconnection of live electrical lines between downhole tools, comprising;

an insulated cylindrical probe, said probe adapted to connect to a first downhole tool;

a cylindrical receptacle housing, said receptacle housing adapted to connect to a second downhole tool, said receptacle housing having an inner insulator sleeve, said housing having an open end adapted to removably receive said probe;

at least three concentric probe electrical contacts disposed axially along an outer surface of said probe;

at least three concentric electrical receptacle contacts disposed axially along an inner surface of said receptacle housing insulator sleeve, said receptacle contacts spaced along the inner surface so as to be matingly juxtaposed with the at least three probe contacts when said probe is seated within said receptacle, thereby creating at least three pairs of contacts, each pair acting cooperatively to conduct electricity; and the at least three contacts on said probe and the at least three contacts on said receptacle are uniquely spaced in the axial direction along said probe and said receptacle such that no more than one of the at least three probe contacts may be aligned with and contacting any of the at least three receptacle contacts, unless said probe is seated within said receptacle during connection and disconnection of the first and second downhole tools.

2. The connector system of claim 1, wherein the housing insulator sleeve is an elastomeric sleeve molded in said housing.

3. The connector system of claim 1, wherein the housing insulator sleeve is a high temperature plastic sleeve adhesively bonded in said housing.

4. A multiple contact wet connector system for preventing cross-coupling during connection and disconnection of live electrical lines, comprising;

an insulated cylindrical probe, a cylindrical receptacle housing, said receptacle housing having an inner insulator sleeve, said housing having an open end adapted to removably receive said probe;

at least three probe electrical contacts disposed axially along an outer surface of said probe;

at least three electrical receptacle contacts disposed axially along an inner surface of said receptacle housing insulator sleeve, said receptacle contacts spaced along the inner surface so as to be matingly juxtaposed with the at least three probe contacts when said probe is seated within said receptacle, thereby creating at least three pairs of contacts, each pair acting cooperatively to conduct electricity;

the contacts on said probe and said receptacle are uniquely spaced in the axial direction along said probe and said receptacle such that no more than one of the at least three probe contacts may be aligned with and contacting any of the at least three receptacle contacts, unless said probe is seated within said receptacle.

5. The connector system of claim 4, wherein the housing insulator sleeve is an elastomeric sleeve molded in said housing.

6. The connector system of claim 4, wherein the housing insulator sleeve is a high temperature plastic sleeve adhesively bonded in said housing.

7. The connector system of claim 4, wherein the at least three receptacle contacts are concentric about the inner surface of said receptacle housing, and the at least three probe contacts are concentric about the outer surface of the probe.

8. A multiple contact connector system for preventing cross-coupling during connection and disconnection of live electrical lines, comprising;

an insulated probe, a receptacle housing, said housing having an open end adapted to removably receive said probe;

at least three probe electrical contacts disposed axially along an outer surface of said probe;

at least three receptacle electrical contacts disposed axially along an inner surface of said receptacle housing, said receptacle contacts spaced along the inner surface so as to be matingly juxtaposed with the at least three probe contacts when said probe is seated within said receptacle, thereby creating at least three pairs of contacts, each pair acting cooperatively to conduct electricity;

the contacts on said probe and said receptacle are uniquely spaced in the axial direction along said probe and said receptacle such that no more than one of the at least three probe contacts may be aligned with and contacting any of the at least three receptacle contacts, unless said probe is seated within said receptacle.

9. The connector system of claim 8, wherein the probe and the receptacle housing are cylindrical.

10. The connector system of claim 9, wherein the at least three receptacle contacts are concentric about the inner surface of said receptacle housing, and the at least three probe contacts are concentric about the outer surface of the probe.

11. A method for preventing cross-coupling during connection and disconnection of multiple live electrical lines, comprising;

using a multiple contact connector system having a probe and a receptacle for receiving the probe;

selecting the spacing of at least three probe contacts and at least three receptacle contacts such that no more than one of the at least three probe contacts may be aligned with and contacting any of the at least three receptacle contacts, unless said probe is seated within said receptacle.

12. A method for preventing cross-coupling during connection of multiple live electrical lines in downhole tools, comprising;

using a multiple contact connector system comprising;

an insulated probe with at least three electrical contacts disposed axially along an outer surface of said probe, said probe adapted to install into a first downhole tool;

a receptacle housing, said housing adapted to install into a second downhole tool, said housing having an open end adapted to removably receive said probe when said first downhole tool is connected or disconnected to said second downhole tool, said housing having at least three electrical contacts disposed on an inner surface so as to be matingly juxtaposed with the at least three probe contacts when said probe is seated within said receptacle, thereby creating at least three pairs of contacts, each pair acting cooperatively to conduct electricity;

selecting the spacing of said at least three probe contacts and said at least three receptacle contacts such that no more than one of the at least three probe contacts may be aligned with and contacting any of the at least three receptacle contacts, unless said probe is seated within said receptacle during connection and disconnection of the first and second downhole tools.

* * * * *